US007380617B1

(12) United States Patent
James

(10) Patent No.: US 7,380,617 B1
(45) Date of Patent: Jun. 3, 2008

(54) DRILL CUTTINGS HANDLING APPARATUS

(75) Inventor: Michael H. James, Marigouin, LA (US)

(73) Assignee: Triton Industries, LLC, Lottie, LA (US)

( * ) Notice: Subject to any disclaimer, the term of this patent is extended or adjusted under 35 U.S.C. 154(b) by 83 days.

(21) Appl. No.: 11/294,902

(22) Filed: Dec. 6, 2005

Related U.S. Application Data

(60) Provisional application No. 60/633,877, filed on Dec. 6, 2004.

(51) Int. Cl.
*E21B 21/00* (2006.01)

(52) U.S. Cl. ..... 175/66; 175/206; 175/207; 209/12.1

(58) Field of Classification Search ..... 175/66, 175/206, 207; 209/12.1
See application file for complete search history.

(56) References Cited

U.S. PATENT DOCUMENTS 3,895,927 A * 7/1975 Bournham, Sr. ..... 96/163
6,170,580 B1 * 1/2001 Reddoch ..... 175/66
6,585,115 B1 * 7/2003 Reddoch et al. ..... 209/3
2005/0039816 A1 * 2/2005 Maguire ..... 141/8
2005/0074302 A1 * 4/2005 Burnett ..... 406/56

* cited by examiner

*Primary Examiner*—William P Neuder
(74) *Attorney, Agent, or Firm*—William Stagg; Chad Grand

(57) ABSTRACT

A drill cuttings handling system apparatus for use on an oil and gas drilling rig located on a drilling platform where the platform has drilling equipment that includes a system for circulating drilling mud through the borehole created by the drilling equipment that includes a drill cuttings shaker for removing drill cuttings from the circulating drilling mud and a drill cuttings collection trough. The drill cuttings handling system is comprised of a cyclone cuttings hopper, a vacuum pump, an engine and a solids pump. Conduit is attached to the cyclone cuttings hopper for delivering by vacuum flow a quantity of drill cuttings from the drill cuttings collection trough of the drilling mud system of the drilling rig to the cyclone cuttings hopper. Discharge conduit is connected to the solids pump to dispense drill cuttings from the solids pump to a desired location such as a cuttings box. Control means for detecting the level of cuttings in the system and remotely controlling the flow of cuttings into and out of the hopper by remote control of valves and/or pumps is utilized.

31 Claims, 2 Drawing Sheets

DRILL CUTTINGS HANDLING APPARATUS

This application claims priority to U.S. Provisional Application Ser. No. 60/633,877 for Drill Cuttings Handling Apparatus filed by Applicant on Dec. 6, 2004, the entire content of which is hereby incorporated by reference.

FIELD OF INVENTION

This invention relates to a method and apparatus incorporating a portable vacuum and pumping system to monitor and control the handling of materials such as drill cuttings produced during the drilling of oil and gas wells.

BACKGROUND OF INVENTION

In the drilling of oil and gas wells, whether offshore or onshore, rotary drilling techniques require the use of drilling mud circulated through the borehole during the drilling process. Typically, the drilling mud is pumped from a mud holding tank, through mud supply lines, down through the borehole and returned to the surface of the borehole. The circulating drilling mud, as it is returned to the surface of the borehole, is used to carry the drill cuttings produced from the bottom of the advancing borehole to the surface for disposal.

The drilling mud that is returned to the surface, along with the carried drill cuttings, is typically transferred to a shaker or sieving device that is utilized to remove the carried drill cuttings drilling mud. The drilling mud, absent the removed drill cuttings, is re-circulated to the borehole and the drill cuttings, removed by the shaker, are typically collected in a drill cuttings collection trough that is in communication with the shaker and conveyed to dryers for further processing on the rig or to storage boxes or containers for treatment and disposal at a later time.

Various techniques are currently utilized to convey the drill cuttings from the drill cuttings collection trough. These techniques include the use of conveyors, chutes, and suction lines. These techniques, whether the incorporate conveyors, chutes, suction lines or combinations thereof, typically require elaborate networks of conveyors, hoses, chutes, and tanks that take up valuable rig space. These systems typically require substantial amounts of time to set up and take down which can have a negative impact on the time associated with the drilling process.

The present invention is designed to provide a portable vacuum and pumping apparatus and system to handle drill cuttings that may be brought to the well location in single a unit. The unit is easily set up for use and is easily removed from the well location. The unit is easy to operate and maintain, provides a method and means to monitor and control the flow of cuttings through the unit and thus eliminates many of the problems associated with conventional drill cuttings systems. All of the components of the system may be incorporated onto a transportable skid for easy transportation to and from a drill site.

SUMMARY OF INVENTION

The present invention provides a portable vacuum and pumping apparatus and system for handling slurries of solids such as the slurry comprised of drill cuttings produced during the drilling of oil and gas wells. The components of the proposed invention can be easily transported and setup on a job location. Because of such portability, ease of assembly, and small footprint, the system it is particularly suitable for use on oil and gas drilling platforms.

All of the essential components of the drill cuttings handling apparatus may also be arranged and housed as a unit on a transportable skid to minimize the amount of platform deck space utilized by the unit. The transportable skid may be equipped with removable lifting lugs to facilitate its transport to and from the drilling platform or well location.

The invention is comprised of a cyclone cuttings hopper, a device for detecting the level of cuttings and other materials contained in the cuttings hopper, a vacuum pump for creating suction in the cuttings hopper, a hopper vacuum relief valve, a solids pump, engine means for operating the vacuum pump and the solids pump, inlet and outlet valves and piping, and means for delivering the detected levels to a control mechanism for regulating the flow of drill cuttings into and out of the cuttings hopper. In operation, at least one vacuum line is placed in the cuttings trough and connected to an inlet in the cuttings hopper. A cuttings discharge line is then attached to the outlet of the solids pump and directed to a cuttings dryer, a cuttings storage box, or other interim storage location.

With the hopper vacuum relief valve closed, and the vacuum pump in operation, drill cuttings are drawn from the cuttings trough through the vacuum lines and in to the cuttings hopper by means of a vacuum created in the cuttings hopper by means of the vacuum pump. Drill cuttings accumulated in the cuttings hopper are discharged to the solids pump by gravity means and then pumped by the solids pump to a cuttings dryer, to cuttings storage boxes, or to other desired destinations via the cuttings discharge line.

The level or volume of cuttings retained in the cuttings hopper may be monitored by a monitoring device, such as an ultrasonic or sonar sensor and system or a by a photoelectric sensor and system, to deliver and receive signals to detect the level of drill cuttings in the hopper and transmit the signals to a control system. The control system can then generate desired signals to regulate the hopper vacuum relief to control the vacuum maintained in the hopper so as to keep an efficient flow of cuttings in to and out of the cuttings hopper. The system, if desired, may also be used to generate a control signal, based upon the detected level of cuttings in the cuttings hopper, to regulate the concrete pump and thereby the flow of cuttings from the system.

The components of the system may be easily transported to and from a well location by trucking or other means. The components may be arranged an mounted on a skid to facilitate transportation of the system. When mounted on a skid, all of the essential components of the apparatus may be contained and incorporated into a single unit. Such a unit may be easily added to or removed from a drilling mud system of a drilling rig assembly. The ease of addition and removal of a unit allows for the ready addition or replacement of a unit in the event of capacity requirements or unit malfunction. Maintenance on the replaced apparatus can then be conducted with little impact on the drilling operation.

DESCRIPTION OF EMBODIMENT

Figure 1:
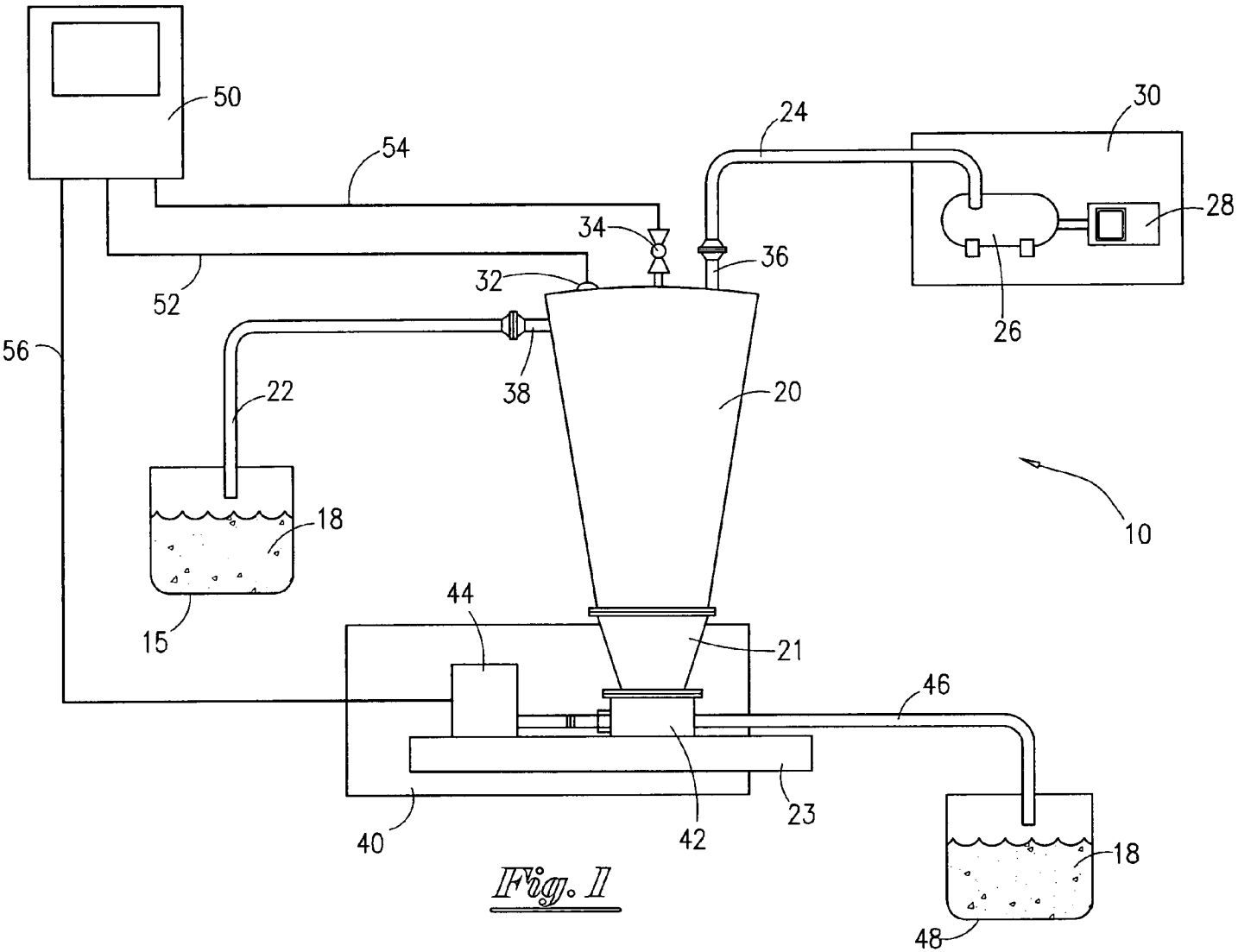
FIG. 1 is a schematic diagram of the apparatus and method of applicant's invention.

Referring now to the drawings and more particularly to FIG. 1 there is shown a schematic diagram of the proposed materials handling system (10) to be used as a means for handling slurries of solids such as the slurry comprised of drill cuttings produced during the drilling of oil and gas wells. The system (10) is comprised of a slurry collection tank such as a cyclone cuttings hopper (20), a vacuum system (30), at least one suction line (22), a cuttings discharge system (40), and a control system (50).

The vacuum system (30) is comprised of a vacuum line (24), a vacuum pump (26), with associated valves and fittings, and a power means (28). It is thought that the power means (28) would be a diesel engine having a horsepower rating sufficient for operating the vacuum pump (26) at a pressure level in the cuttings hopper (20), via vacuum line (24), sufficient to create a desired vacuum or suction level though power means of equivalent power ratings such as electric engines could also be utilized.

The cuttings hopper (20) has a vacuum line inlet (36) in communication with the vacuum line (24), which is in turn in communication with a vacuum pump (26). The hopper (20) is also provided with at least one suction inlet (38) that is in communication with a suction line (22). A vacuum relief valve (34) is mounted to cuttings hopper (20) to regulate the vacuum level generated in the hopper (20). In an embodiment, the transition between the cuttings hopper (20) and the vacuum relief valve (34) is an atmospheric conduit.

Mounted at the base of the cuttings hopper (20) is the cuttings discharge system (40). The discharge system (40) is comprised of a hopper outlet (21) in communication with the hopper (20), a solids pump (42) having an inlet to receive a flow of cuttings from the hopper outlet (21), power means (44) for operating the solids pump (42), and a discharge line (46) in communication with the solids pump (42) for delivering a flow of cuttings and other material from the solids pump (42). It is thought that the solids pump (42) will be a concrete pump having an operating lift and pressure sufficient to convey drill cuttings as described herein though other types of solids pump and motor combinations might also be utilized. Solids pumps such as those manufactured by REED®, 13822 Oaks Avenue, Chino, Calif., 91710, USA are thought to be a suitable solids pump (42), in particular, the pumps utilized in the REED® Model A30 and A30HP "Rockmaster" or the REED® C Series Concrete pumps are thought suitable for use with Applicant's system, though pumps of other models and manufacturers may also be used.

Mounted within the cuttings hopper (20) is a means (32) for continuously detecting the level of drill cuttings and other materials contained in the cuttings hopper (20). The means (32) for continuously detecting the level of drill cuttings may be a monitoring device, such as an ultrasonic or sonar sensor and system or a by a photoelectric sensor and system. A suitable means (32) for continuously detecting the level of drill cuttings would be those manufactured by the Madison® Company, 27 Business Park Dr., Branford, Conn. 06405, USA. In particular, the Madison® Model U3/U4 ultrasound level sensors and the Madison® R3/R4 radar level sensors are thought suitable for use with Applicant's system, though sensors of other models and manufacturers may also be used.

The means (32) for continuously detecting the level of drill cuttings includes means (52) for delivering or transmitting the signals so detected to a control system (50). The control system (50) maybe be calibrated by computer means or otherwise to then generate desired control signals via vacuum control signal means (54) to regulate the hopper vacuum relief valve (34) to control the vacuum pressure maintained in the cuttings hopper (20) so as to keep an efficient flow of cuttings in to and out of the cuttings hopper (20). Such control systems are thought to be generally well known. The control system (50), if desired, may also be used to generate a control signal, via control signal means (56), based upon the detected level of cuttings in the cuttings hopper (20) from the detecting means (32), to regulate the concrete pump (42) and thereby the flow of cuttings to and from the cuttings discharge line (46).

In operation, as shown in schematic drawing FIG. 1, the system (10) comprised of the cuttings hopper (20) its other component parts is mounted on a platform (23) such as the bed of a truck or on a skid where it may be readily transported to a drill location. The system (10) may also be assembled directly on the ground or the floor or work area where it is to be utilized. Assembly includes attaching the cuttings suction line (22) to the cuttings inlet (38) of the cuttings hopper (20) and running the cuttings suction line (22), so attached, to a cuttings trough (15) of a drilling rig system and attaching the cuttings discharge line (46) to the solids pump (42) and extending the discharge line (46) to a desired cuttings collection location (48) such as a cuttings storage box or a cuttings dryer.

Once assembled, the cuttings (18) and any associated liquids are drawn from the cuttings trough (15) via at least one cuttings vacuum line (22) by means of a vacuum or negative pressure created in the cuttings hopper (20) by the vacuum line (24), with associated valves and fittings, by means of the vacuum pump (26) powered by the engine (28). Cuttings (18) drawn into the cuttings hopper (20) via cuttings inlet (38) are discharged from hopper (20) to the hopper outlet (21) via gravity means to the inlet of the solids pump (42) powered by the engine (44). Cuttings (18) are then pumped via the solids pump (42) though the cuttings discharge line (46) to a desired destination (48) such as a cuttings box or a cuttings dryer.

Figure 2:
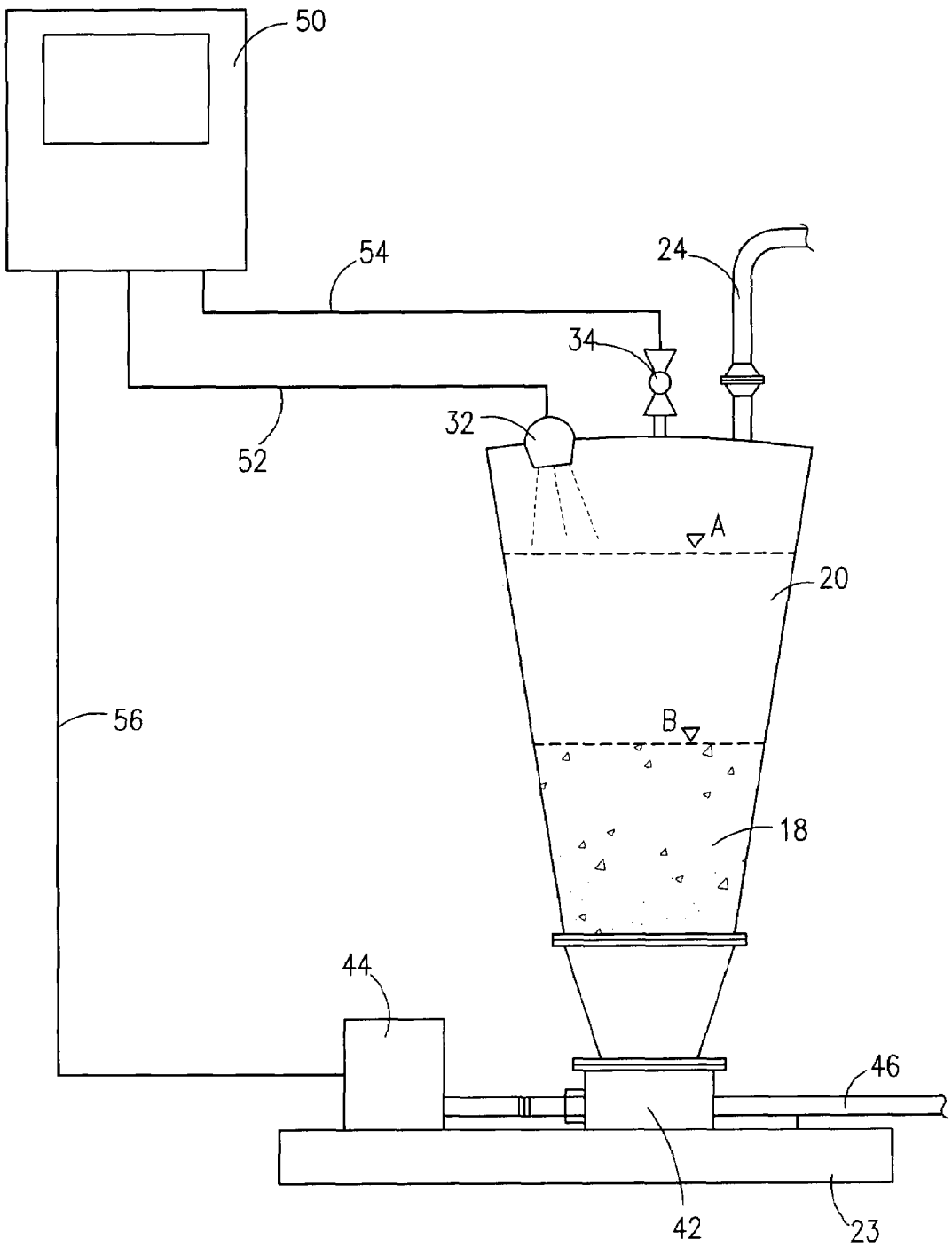
FIG. 2 is a schematic sectional view of the apparatus of FIG. 1.

As shown in FIG. 2, showing a cross-sectional schematic of the hopper (20), the means (32) for continuously detecting the level of drill cuttings and other materials monitors the level of drill cuttings and other materials drawn into the cuttings hopper (20) via the suction line (22) during operation of the system (10). This means (32) for level detection, thought to be an ultrasonic transducer and sensor system, generates and detects signals to determine the cuttings level in the hopper (20) and delivers the detected signals to the control system (50) via signal transmitting means (54).

For example, when the cuttings level in the hopper (20) is at a desired level designated as "A" in FIG. 2, a signal is delivered from the detection means (32) to the control system (50) might be processed to generate a signal from the control system (50) to the vacuum relief valve (34). The signal so generated may be used to open or close the relief valve (34) and thereby reduce or increase the vacuum pressure in the hopper (20) and, consequently, the flow of cuttings (18) from the cuttings trough (15) to the hopper (20).

Similarly, when the cuttings level in the hopper (20) is at a desired level designated as "B" in FIG. 2, a signal is delivered from the detection means (32) to the control system (50) might be processed to generate a signal from the control system (50) to the discharge system (40). The signal so generated may be used to regulate the solids pump (42) and thereby shutoff or continue the discharge of cuttings (18) from the system (10). Various types of control systems and valve arrangements may be utilized to control the cuttings collection system from the control system (50) based upon the level of cuttings detected in the hopper (20) by the means for level detection (32) and thus the flow of drill cuttings into and from the cuttings hopper and the solids pump.

The control system (50 may be utilized to control the operations of the various engines, the pumps, and any attendant valves and it is thought that various types of control means are well known and might be adapted for such use including hydraulic, electric or pneumatic control systems.

When the cyclone cuttings hopper (20), the vacuum pump (26), the engines (28, 44), and the solids pump (42) are positioned on and mounted to a base or skid (23) they may be positioned in such a fashion so as keep the overall dimension of the base or skid (23) to a minimum. Lifting lugs may be attached to the base (23) so as to provide a means for securing lifting lines to facilitate moving the system (10) as desired. In certain configurations, a single engine (28, 44) might be used to operate both the vacuum pump (26) and the solids pump (42) so as to further reduce the minimum surface area required for the system.

It is thought that the material handling system presented herein and many of its attendant advantages will be understood from the foregoing description. It is also thought that it will be apparent that various changes may be make in the form, construction and arrangement of the parts the system without departing from the spirit and scope of the invention or sacrificing all of its material advantages.

I claim:

1. A material handling apparatus comprised of:

a) a portable container;

b) a means for creating a vacuum in said portable container and thereby drawing material into said portable container;

c) a means for discharging material from said portable container to a desired location;

d) a means for continuously detecting and transmitting the level of material located in said portable container; and e) a control mechanism, said control mechanism being in cooperation with said means for continuously detecting and transmitting the level of material drawn into said portable container and thereby controlling said level of material located in said portable container.

2. The apparatus of claim 1, wherein said control mechanism further comprises:

a) a vacuum relief valve, said vacuum valve being in communication with said portable container; and b) a means for regulating said vacuum relief valve and generating a control signal, said means being in cooperation with said vacuum relief valve.

3. The apparatus of claim 2, wherein:

a) said portable container further comprising at least one vacuum conduit, at least one inlet conduit, at least one atmospheric conduit, and at least one outlet conduit, said atmospheric conduit being in communication with said vacuum relief valve;

b) said means for creating a vacuum further comprises, at least one vacuum pump, at least one vacuum line, and a means for operating said vacuum pump; said vacuum line being in cooperation with said vacuum pump and said inlet conduit; and c) said means for discharging material further comprises, at least one solids pump; at least one discharge line, and a means for operating said solids pump; said solids pump being in communication with said outlet conduit, and said discharge line being in communication with said solids pump.

4. The apparatus of claim 3, wherein said means for regulating said vacuum relief valve and generating a control signal is a computer.

5. The apparatus of claim 3, wherein said means for continuously detecting and transmitting the level of material located in said portable container is an ultrasonic sensor.

6. The apparatus of claim 3, wherein said means for continuously detecting and transmitting the level of material located in said portable container is a sonar sensor.

7. The apparatus of claim 3, wherein said means for continuously detecting and transmitting the level of material located in said portable container is a photoelectric sensor.

8. The apparatus of claim 3, wherein said means for continuously detecting and transmitting the level of material located in said portable container is a radar sensor.

9. An apparatus for transporting material slurries such as drill cuttings comprised of:

a) a portable hopper, having at least one vacuum conduit, at least one inlet conduit, at least one atmospheric conduit; and at least one outlet conduit;

b) a means for drawing a material slurry into said hopper, said means comprising at least one vacuum pump, at least one vacuum line, and a means for operating said vacuum pump; said vacuum line being in cooperation with said vacuum pump and said inlet conduit;

c) a means for discharging said material slurry from said portable hopper comprising at least one solids pump; at least one discharge line, and a means for operating said solids pump; said solids pump being in cooperation with said outlet conduit and said discharge line;

d) a vacuum relief valve; said vacuum relief valve being in cooperation with said atmospheric conduit;

e) a control mechanism comprising a means for regulating said vacuum relief valve and generating a control signal; and f) a means for continuously detecting and transmitting the level of said material slurry located in said portable hopper, said mean for continuously detecting and transmitting the level of said material slurry located in said portable hopper being in cooperation with said control mechanism.

10. The apparatus of claim 9, wherein said means for continuously detecting and transmitting the level of material located in said portable hopper is an ultrasonic sensor.

11. The apparatus of claim 9, wherein said means for continuously detecting and transmitting the level of material located in said portable hopper is a sonar sensor.

12. The apparatus of claim 9, wherein said means for continuously detecting and transmitting the level of material located in said portable hopper is a photoelectric sensor.

13. The apparatus of claim 9, wherein said solids pump is a concrete pump.

14. A method for handling drill cuttings comprising the steps of:

a) transporting cuttings and any associated liquids from a predetermined location into a portable hopper;

b) activating a monitoring means for continuously detecting and transmitting the level of drill cuttings and other materials drawn into said portable hopper;

c) controlling the level of said cuttings and associated liquids by a control mechanism in communication with said monitoring means; and d) discharging said cuttings from the portable hopper to a desired destination.

15. The method of claim 14, wherein said step of transporting cuttings and any associated liquids, further comprises:

a) attaching at least one suction line to at least one inlet conduit of said portable hopper;

b) attaching said suction line to a cuttings trough;

c) attaching at least one vacuum line to at least one vacuum conduit located on said portable hopper;

d) attaching said vacuum line to vacuum pump; and e) activating said vacuum pump.

16. The method of claim 15, wherein said step of discharging said cuttings to a desired location, further comprises:

a) attaching a solids pump to at least one outlet conduit of said portable hopper b) attaching at least one discharge line to said solids pump;

c) extending said discharge line to a desired cuttings collection location; and d) activating said solids pump.

17. The method of claim 16, wherein said monitoring means for continuously detecting and transmitting the level of drill cuttings and other materials drawn into said portable hopper is an ultrasonic sensor.

18. The method of claim 16, wherein said monitoring means for continuously detecting and transmitting the level of drill cuttings and other materials drawn into said portable hopper is a sonar sensor.

19. The method of claim 16, wherein said monitoring means for continuously detecting and transmitting the level of drill cuttings and other materials drawn into said portable hopper is a photoelectric sensor.

20. The method of claim 16, wherein said monitoring means for continuously detecting and transmitting the level of drill cuttings and other materials drawn into said portable hopper is a radar sensor.

21. The method of claim 14 wherein said step of controlling the level of said cuttings and associated liquids further comprises controlling communication between said portable hopper and the atmosphere.

22. The method of claim 21 wherein said step of controlling communication between said portable hopper and the atmosphere further comprises controlling a vacuum relief valve so that communication between said portable hopper and the atmosphere varies with respect to the position of the vacuum relief valve.

23. An apparatus for handling drill cuttings comprised of:

a) a container, said container having at least one vacuum conduit, at least one inlet conduit, at least one atmospheric conduit, and at least one outlet conduit, said atmospheric conduit being in communication with a vacuum relief valve;

b) a means for creating a vacuum in said container whereby drill cuttings are drawn into said container through said inlet conduit;

c) a means for discharging said drill cuttings from said container to a desired location;

d) a means for continuously detecting and transmitting the level of said drill cuttings located in said container; and e) a control mechanism, said control mechanism being in cooperation with said means for continuously detecting and transmitting the level of said drill cuttings drawn into said portable container and said vacuum relief valve and thereby controlling said level of said drill cuttings located in said portable container.

24. The apparatus of claim 23, wherein:

a) said means for creating a vacuum in said container includes, at least one vacuum pump, at least one vacuum line, and a means for operating said vacuum pump; said vacuum line being in cooperation with said vacuum pump and said inlet conduit; and b) said means for discharging said drill cuttings includes, at least one solids pump; at least one discharge line, and a means for operating said solids pump; said solids pump being in communication with said outlet conduit, and said discharge line being in communication with said solids pump.

25. The apparatus of claim 24, wherein said control mechanism further comprises:

a) a means for regulating said vacuum relief valve and generating a control signal, said means for regulating said vacuum relief valve and generating a control signal being in cooperation with said vacuum relief valve.

26. The apparatus of claim 25, wherein said means for regulating said vacuum relief valve and generating a control signal is a computer.

27. The apparatus of claim 25, wherein said means for continuously detecting and transmitting the level of said drill cuttings located in said portable container is an ultrasonic sensor.

28. The apparatus of claim 25, wherein said means for continuously detecting and transmitting the level of said drill cuttings located in said portable container is a sonar sensor.

29. The apparatus of claim 25, wherein said means for continuously detecting and transmitting the level of said drill cuttings located in said portable container is a photoelectric sensor.

30. The apparatus of claim 25, wherein said means for continuously detecting and transmitting the level of said drill cuttings located in said portable container is a radar sensor.

31. The apparatus of claim 25, wherein said control mechanism further comprises:

a) means for regulating said solids pump and generating a control signal, said means for regulating said solids pump and generating a control signal being in cooperation with said solids pump.

* * * * *